US011536088B2

(12) United States Patent
Leng

(10) Patent No.: US 11,536,088 B2
(45) Date of Patent: Dec. 27, 2022

(54) FOLDING LADDER AND TOP TRAY THEREOF

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 341 days.

(21) Appl. No.: 16/794,180

(22) Filed: Feb. 18, 2020

(65) Prior Publication Data

US 2020/0263497 A1 Aug. 20, 2020

(30) Foreign Application Priority Data

Feb. 18, 2019 (CN) ..... 201920207576.3

(51) Int. Cl.
*E06C 7/14* (2006.01)
*E06C 1/20* (2006.01)
*E06C 1/393* (2006.01)

(52) U.S. Cl.
CPC ..... *E06C 7/14* (2013.01); *E06C 1/20* (2013.01); *E06C 1/393* (2013.01)

(58) Field of Classification Search
CPC ... E06C 1/20; E06C 1/393; E06C 7/14; E05D 15/58; E05D 15/582; E05D 15/581; E05D 2015/585; B65D 43/20
See application file for complete search history.

(56) References Cited

U.S. PATENT DOCUMENTS 2,661,119 A * 12/1953 Spiess, Jr. ..... B65D 43/20 220/815
3,422,988 A * 1/1969 Lafranca ..... A47K 10/427 220/815
RE28,994 E * 10/1976 Aylworth ..... E06B 3/5045 312/139.2
4,048,050 A * 9/1977 Hillman ..... B65D 50/045 220/812
4,516,813 A * 5/1985 Sekerich ..... E06B 3/5045 312/109
4,666,036 A * 5/1987 Bourbon ..... B65D 43/14 206/45.24
4,836,394 A * 6/1989 Glomski ..... E05D 3/022 220/811

(Continued)

*Primary Examiner* — Daniel P Cahn
*Assistant Examiner* — Shiref M Mekhaeil
(74) *Attorney, Agent, or Firm* — Cooper Legal Group, LLC

(57) ABSTRACT

The present disclosure discloses a folding ladder and a top tray thereof. The top tray comprises a fixed plate and a movable plate. The movable plate is disposed on a rear side of the fixed plate and is rotatably connected to the fixed plate, and the movable plate is configured to be rotated to switch between an unfolded position and a folded position. When the movable plate is in the unfolded position, the movable plate is horizontally arranged side-by-side with the fixed plate, and a rear surface of the fixed plate abuts a front surface of the movable plate to maintain the movable plate in a horizontal position and to resist a downward force of gravity. When the movable plate is subjected to an upward pushing force and is rotated to be folded into the folded position, the movable plate abuts the rear side of the fixed plate.

12 Claims, 6 Drawing Sheets

(56) References Cited

U.S. PATENT DOCUMENTS 4,889,257 A * 12/1989 Steffes ..... A45C 5/00 220/815
5,082,631 A * 1/1992 Lenmark, Sr. ..... B01L 9/06 220/772
5,150,806 A * 9/1992 Glomski ..... E05D 11/1028 220/908
5,263,576 A * 11/1993 Boreen ..... B65D 43/20 220/345.2
5,573,081 A * 11/1996 Bartnicki ..... E06C 7/14 182/129
5,730,451 A * 3/1998 Walker ..... B65F 1/1468 220/908
5,740,883 A * 4/1998 Trank ..... E06C 7/14 248/210
5,873,433 A * 2/1999 Katz ..... E06C 7/14 248/210
5,913,380 A * 6/1999 Gugel ..... E06C 7/182 248/210
6,196,405 B1 * 3/2001 Kambouris ..... G11B 31/00
6,443,260 B1 * 9/2002 Katz ..... E06C 7/14 248/238
6,467,577 B1 * 10/2002 Charlebois, Jr. ..... E06C 7/14 248/210
6,557,958 B1 * 5/2003 Motta ..... E05D 15/42 312/319.2
7,032,711 B1 * 4/2006 Katz ..... B25H 3/06 248/238
7,370,726 B1 * 5/2008 Chavez ..... E06C 1/18 248/210
7,987,555 B2 * 8/2011 Chen ..... E05F 5/02 16/50
8,215,728 B2 * 7/2012 Mehmen ..... B25H 3/02 312/290
10,138,680 B2 * 11/2018 Williams ..... E06C 7/14
2003/0057022 A1 * 3/2003 Leng ..... E06C 7/50 182/165
2016/0348434 A1 * 12/2016 Williams ..... E06C 7/14

* cited by examiner

FOLDING LADDER AND TOP TRAY THEREOF

RELATED APPLICATIONS

This application claims priority to Chinese Patent Application 201920207576.3, filed on Feb. 18, 2019, which is incorporated herein by reference.

FIELD OF THE DISCLOSURE

The present disclosure relates to a folding ladder and a top tray thereof.

BACKGROUND OF THE DISCLOSURE

There are mainly two types of folding ladders: A-frame ladders and retractable ladders. Retractable ladders need to be stabilized when in use. A-frame ladders can stably support themselves on the ground upon being unfolded, which is more convenient. A-frame ladders comprise a front ladder frame and a rear ladder frame. The front ladder frame and the rear ladder frame are hinged together to define a switchable structure. In order to improve climbing and placement of tools, some A-frame ladders comprise a top tray at a top portion of the front ladder frame or the rear ladder frame, and people can place tools on the top tray.

However, in order to facilitate folding and storage of the A-frame ladder, an area of existing top tray is small, and the tools easily slide off.

BRIEF SUMMARY OF THE DISCLOSURE

The present disclosure provides a folding ladder and a top tray thereof to solve deficiencies of the background techniques. In order to solve the aforementioned technical problems, a technical solution of the present disclosure is as follows.

A top tray of a folding ladder comprises a fixed plate and a movable plate. The movable plate is disposed on a rear side of the fixed plate and is rotatably connected to the fixed plate, and the movable plate is configured to be rotated to switch between an unfolded position and a folded position. When the movable plate is in the unfolded position, the movable plate is horizontally arranged side-by-side with the fixed plate, and a rear surface of the fixed plate abuts a front surface of the movable plate to maintain the movable plate in a horizontal position and to resist a downward force of gravity. When the movable plate is subjected to an upward pushing force and is rotated to be folded into the folded position, the movable plate abuts the rear side of the fixed plate.

In a preferred embodiment, each of at least one connection shaft is disposed along a left-right direction of the fixed plate at a position where a top surface of the fixed plate is connected to the rear side of the fixed plate. A top surface of the movable plate is disposed with at least one groove extending in a front-rear direction of the movable plate. A left side and a right side of each of the at least one groove are respectively disposed with a slide groove extending in the front-rear direction of the movable plate. Each of the at least one connection shaft is disposed in a corresponding one of the at least one groove and two ends of each of the at least one connection shaft are slidably and rotatably connected to the slide groove disposed on the left side and the right side of the corresponding one of the at least one groove. When the movable plate is in the unfolded position, each of the at least one connection shaft is disposed at a front end of the corresponding one of the at least one groove. When the movable plate is folded, the movable plate is configured to slide relative to the at least one connection shaft until each of the at least one connection shaft moves to a rear end of the corresponding one of the at least one groove.

In a preferred embodiment, the at least one connection shaft comprises two connection shafts, the two connection shafts are symmetrically disposed on two sides of the fixed plate, the at least one groove comprises two grooves, and the two grooves are symmetrically disposed on two sides of the movable plate.

In a preferred embodiment, the rear surface of the fixed plate and the front surface of the movable plate are inclined surfaces and are coupled with each other.

In a preferred embodiment, at least one shaft sleeve is disposed at a position where the top surface and the rear side of the fixed plate are connected, and each of the at least one shaft sleeve is coupled to a corresponding one of the two grooves. Each of the two connection shafts is disposed in a corresponding one of the at least one shaft sleeve, and the two ends of each of the two connection shafts outwardly extend.

A folding ladder comprises a front ladder frame, a rear ladder frame, and a top tray. Each of two standing columns on a left side and a right side of the rear ladder frame is pivotally connected to a corresponding one of two standing columns on a left side and a right side of the front ladder frame. The top tray comprises a fixed plate and a movable plate. The movable plate is disposed on a rear side of the fixed plate and is rotatably connected to the fixed plate, and the movable plate is configured to be rotated to switch between an unfolded position and a folded position. When the movable plate is in the unfolded position, the movable plate is horizontally arranged side-by-side with the fixed plate, and a rear surface of the fixed plate abuts a front surface of the movable plate to maintain the movable plate in a horizontal position and to resist a downward force of gravity. When the movable plate is subjected to an upward pushing force and is rotated to be folded into the folded position, the movable plate abuts the rear side of the fixed plate. The fixed plate of the top tray is fixedly connected to a top end of each of the two standing columns on the left side and the right side of the front ladder frame.

Compared with the background art, this technical solution has the following advantages:

First, the top tray comprises the fixed plate and the movable plate, and the movable plate is configured to rotate relative to the fixed plate. When not in use, the movable plate raises upward, so that the movable plate is folded to reduce storage space. When in use, the movable plate can be turned down, so that the movable plate can be unfolded to a horizontal state, and the side surface of the fixed plate and the side surface of the movable plate abut each other to resist a force of gravity and to increase stability. Since the top tray comprises the fixed plate and the movable plate, a usable area of the top tray can be increased when the movable plate is unfolded, and thus the folding ladder is able to more securely hold tools.

Second, at least one groove is disposed on the top surface of the movable plate. After the movable plate is folded, the groove can provide space for the at least one connection shaft; that is, the movable plate can move downward under a guidance of the at least one connection shaft. Thus, the height of the movable plate can be reduced, which makes storage more convenient.

Third, the rear surface of the fixed plate and the front surface of the movable plate are inclined surfaces and are coupled with each other. The inclined surfaces abut each other, so that the movable plate is more stable and reliable in the unfolded state.

BRIEF DESCRIPTION OF THE DRAWING

The present disclosure will be further described below with the combination with the accompanying drawings and the embodiments.

DETAILED DESCRIPTION OF THE EMBODIMENTS

Embodiment 1

Figure 1:
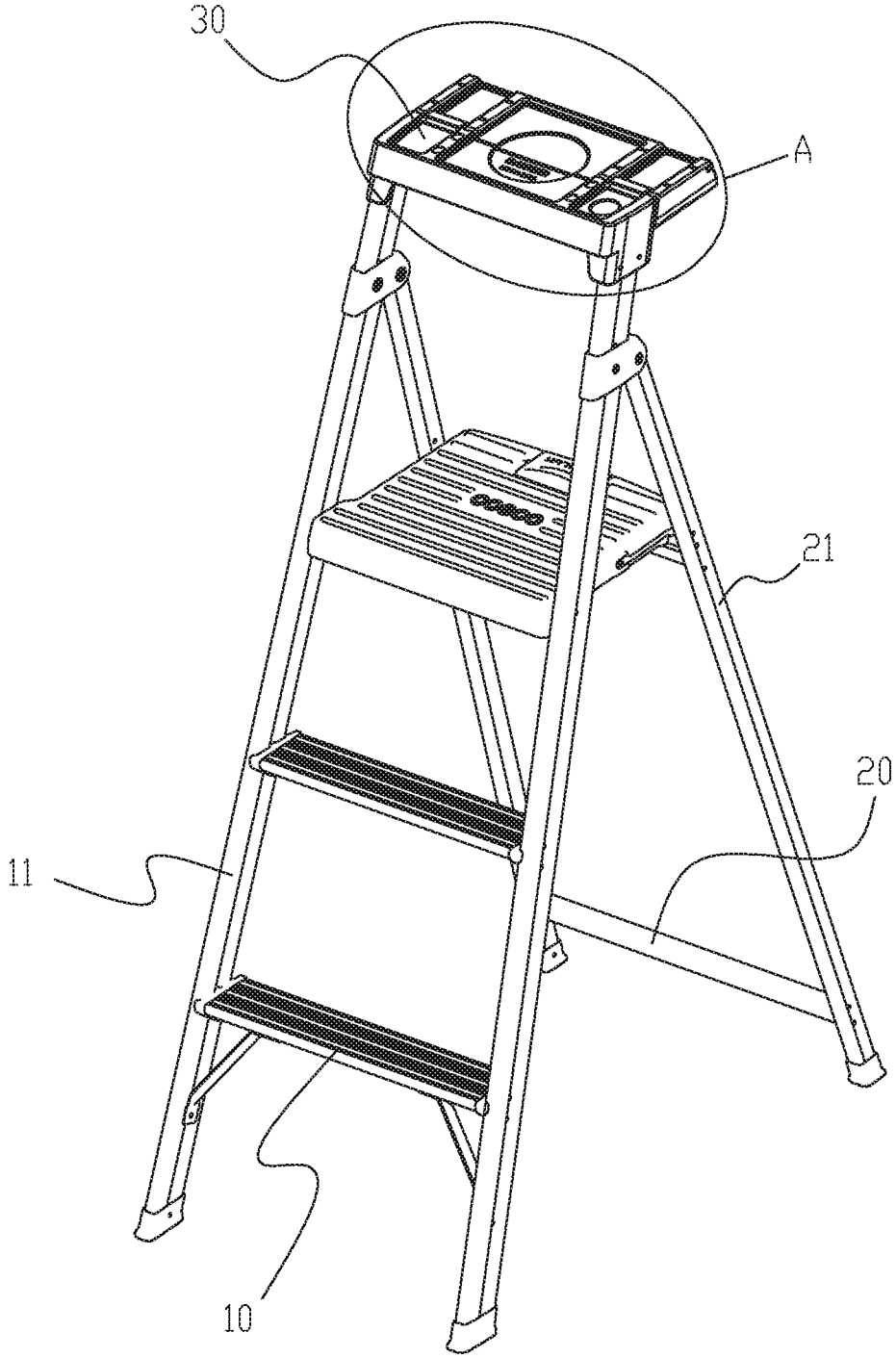
FIG. 1 illustrates a schematic view of a folding ladder of Embodiment 1 of the present disclosure.

Referring to FIGS. 1-6, a folding ladder comprises a front ladder frame 10, a rear ladder frame 20, and a top tray 30. Each of two standing columns 21 disposed on a left side and a right side of the rear ladder frame 20 is pivotally connected to a corresponding one of two standing columns 11 on a left side and a right side of the front ladder frame 10 to define a ladder structure. A connection method between the front ladder frame 10 and the rear ladder frame 20 is conventional and will not be described in detail here. The top tray 30 comprises a fixed plate 32 and a movable plate 34. The fixed plate 32 is fixedly connected to a top end of each of the two standing columns 11 disposed on the left side and the right side of the front ladder frame 10.

Figure 2:
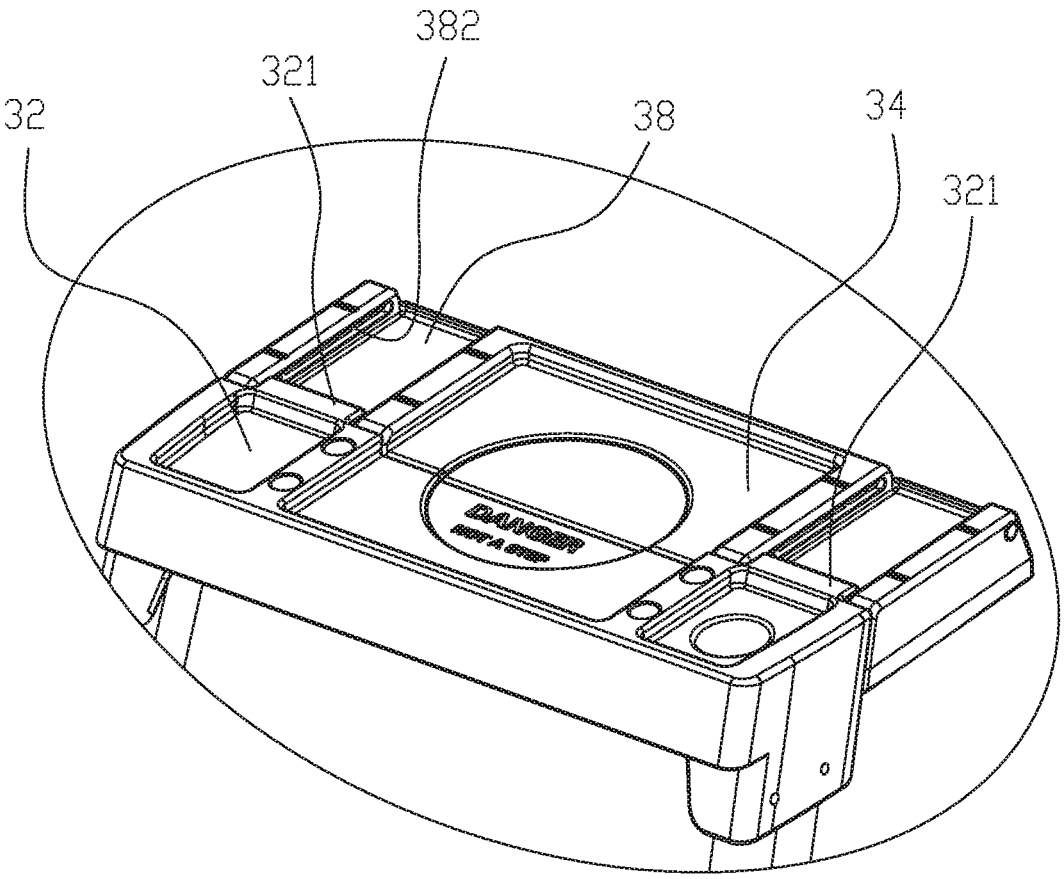
FIG. 2 illustrates an enlarged schematic view of the portion of the folding ladder labeled "A" in FIG. 1.
Figure 3:
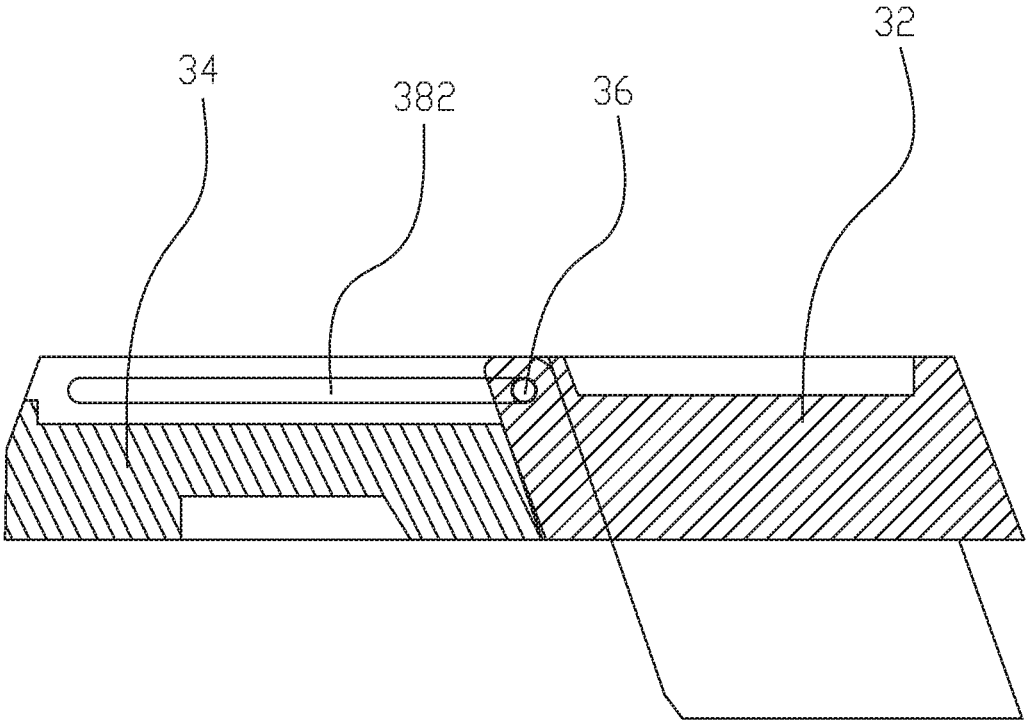
FIG. 3 illustrates a cross-sectional view of a top tray of the folding ladder shown in FIG. 1 when the top tray is in an unfolded position.
Figure 4:
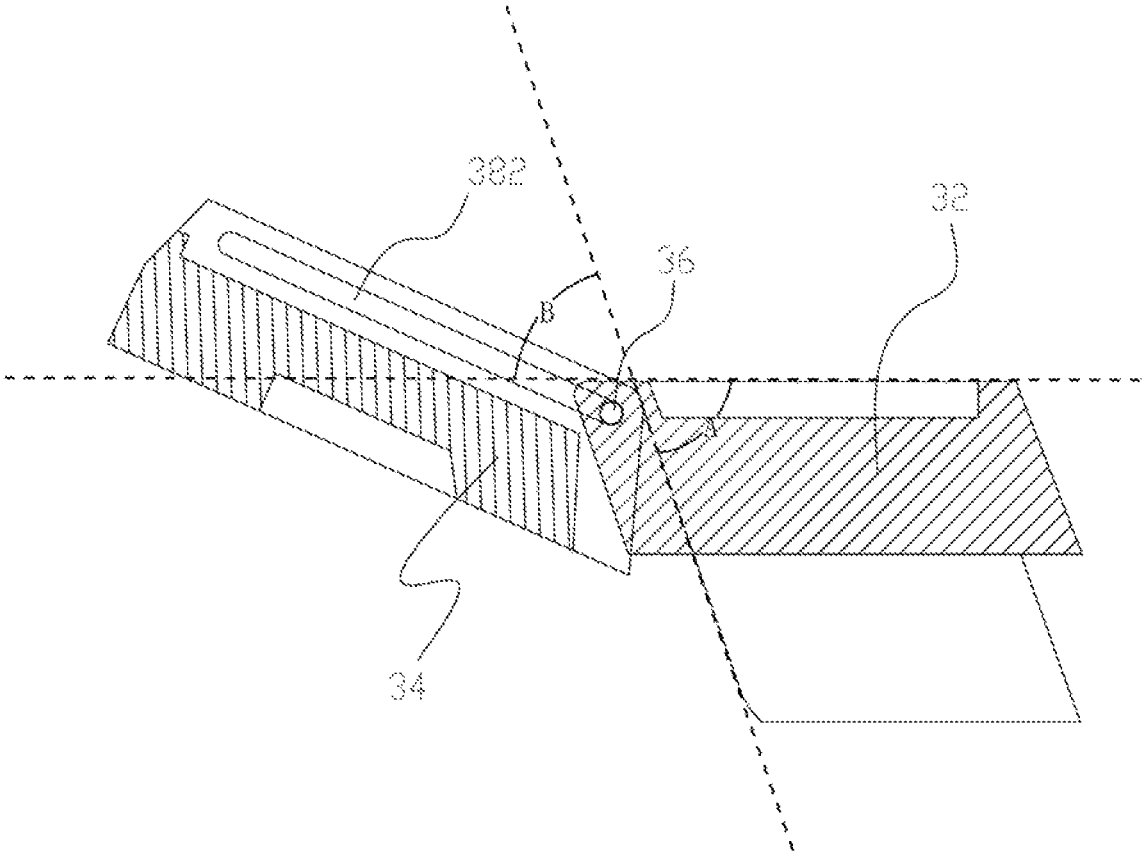
FIG. 4 illustrates a schematic view of the top tray when a movable plate of the top tray is lifted upward.
Figure 5:
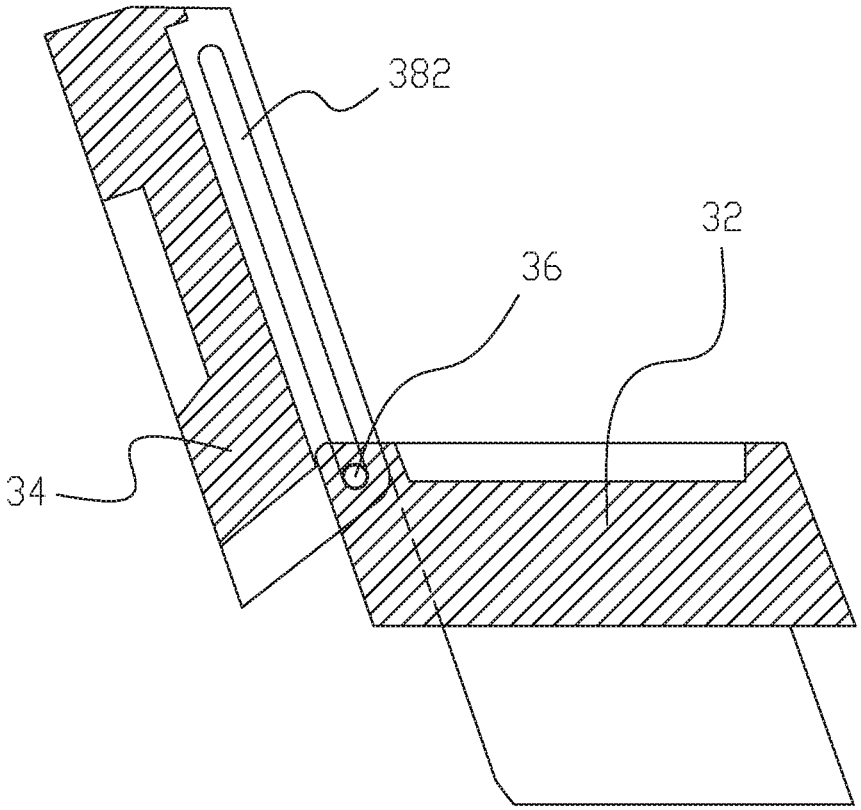
FIG. 5 illustrates a schematic view of the top tray when the movable plate of the top tray abuts a rear side of a fixed plate.

The movable plate 34 is disposed on a rear side of the fixed plate 32 and is rotatably connected to the fixed plate 32. The movable plate 34 is configured to be rotated to switch between an unfolded position (as shown in FIG. 2 and FIG. 3) and a folded position (as shown in FIG. 5) by rotating the movable plate 34. The movable plate 34 is horizontally arranged side-by-side with the fixed plate 32 when in the unfolded position. At this time, a rear surface of the fixed plate 32 abuts a front surface of the movable plate 34 to maintain the movable plate 34 in a horizontal position and to resist a downward force of gravity. When the movable plate 34 is subjected to an upward pushing force, the movable plate 34 is rotated to be folded into the folded position and abuts the rear side of the fixed plate 32 (as shown in FIGS. 4 and 5).

Figure 6:
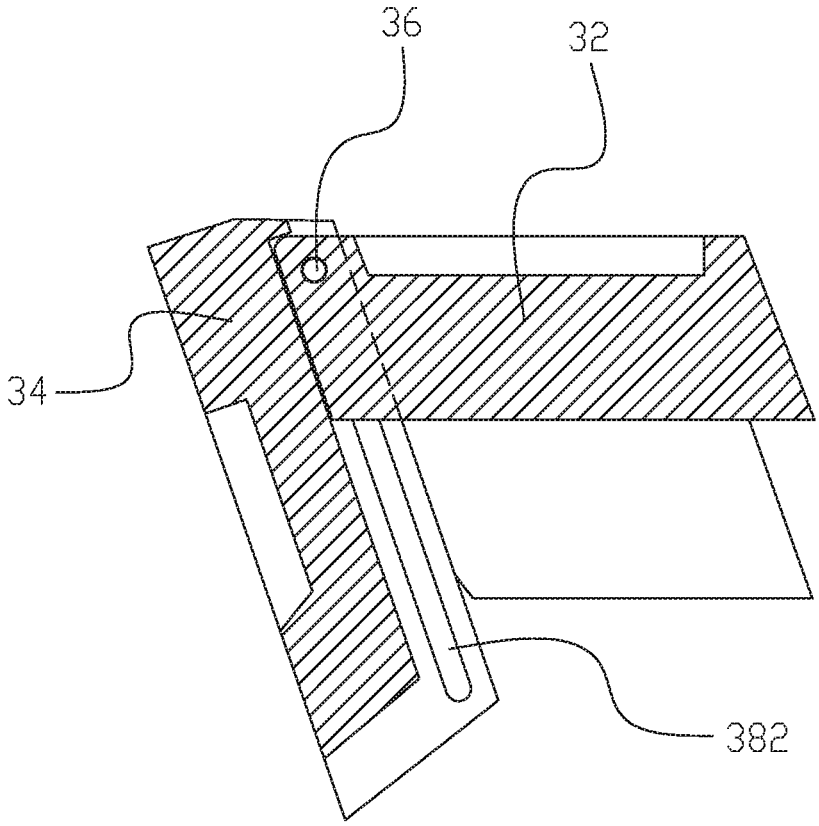
FIG. 6 illustrates a schematic view of the top tray in FIG. 5 after the movable plate slides downward relative to the fixed plate.

Each of at least one connection shaft 36 is disposed along a left-right direction of the fixed plate 32 at a position where a top surface of the fixed plate 32 is connected to the rear side of the fixed plate 32. A top surface of the movable plate 34 is disposed with at least one groove 38 extending in a front-rear direction of the movable plate 34. Each of the at least one groove 38 is disposed relative to a corresponding one of the at least one connection shaft 36. A left side and a right side of each of the at least one groove 38 are respectively disposed with a slide groove 382 extending in the front-rear direction of the movable plate 34. Each of the at least one connection shaft 36 is disposed in a corresponding one of the at least one groove 38 and two ends of each of the at least one connection shaft 36 are slidably and rotatably connected to the slide groove 382 disposed on the left side and the right side of the corresponding one of the at least one groove 38, so that each of the at least one connection shaft 36 is configured to move in the corresponding one of the at least one groove 38. When the movable plate 34 is in the unfolded position, each of the at least one connection shaft 36 is disposed at a front end of the corresponding one of the at least one groove 38. When the movable plate 34 is folded, the movable plate 34 is configured to slide relative to the at least one connection shaft 36 until each of the at least one connection shaft 36 moves to a rear end of the corresponding one of the at least one groove 38 (as shown in FIG. 6), thereby decreasing a height of the movable plate 34. Preferably, the at least one connection shaft 36 comprises two connection shafts 36, the two connection shafts 36 are symmetrically disposed on two sides of the fixed plate 32, the at least one groove 38 comprises two grooves 38, and the two grooves 38 are symmetrically disposed on two sides of the movable plate 34. A first angle A between the top surface of the fixed plate 32 and the rear surface of the fixed plate 32 is less than 90°. When the movable plate 34 in a horizontal position is subjected to an upward pushing force to rotate upward to a second angle B equal to the first angle A, the movable plate 34 slides relative to the at least one connection shaft 36 until the at least one connection shaft 36 moves to a rear end of the at least one groove 38 in the at least one groove 38. The top surface of the movable plate 34 abuts the rear surface of the fixed plate 32.

Preferably, in this embodiment, the rear surface of the fixed plate 32 and the front surface of the movable plate 34 are inclined surfaces and are coupled with each other. Therefore, a contact surface of the fixed plate 32 and the movable plate 34 is increased to make the movable plate 34 more stable when the movable plate 34 is unfolded and a force is applied to the movable plate 34. At least one shaft sleeve 321 is disposed at a position where the top surface and the rear side of the fixed plate 32 are connected. Each of the at least one shaft sleeve 321 is coupled to a corresponding one of the two grooves 38. Each of the two connection shafts 36 is disposed in a corresponding one of the at least one shaft sleeve 321, and the two ends of each of the two connection shafts 36 outwardly extend.

It is easily understood that the movable plate 34 can resist a downward force of gravity when the movable plate 34 is unfolded, and the movable plate 34 can be rotated relative to and abut the fixed plate 32 to reduce an occupied space when the movable plate 34 is folded. It is not necessary for the movable plate 34 to comprise at least one slide groove 382 for sliding.

Although the present disclosure has been described with reference to the preferred embodiments, it will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A top tray of a folding ladder, comprising:
a fixed plate, and
a movable plate, wherein:
the movable plate is disposed on a rear side of the fixed plate and is rotatably connected to the fixed plate,
the movable plate is configured to be rotated to switch between an unfolded position and a folded position,
a top of the fixed plate comprises at least one connection shaft on a rear side of the fixed plate along a left-right direction of the fixed plate,
a top surface of the movable plate comprises at least one groove extending in a front-rear direction of the movable plate,
the at least one connection shaft is disposed in the at least one groove,
a left side and a right side of the at least one groove respectively comprise slide grooves extending in the front-rear direction of the movable plate,
wherein the at least one connection shaft comprises two ends; each end of the two ends is slidably and rotatably connected to a respective slide groove of the slide grooves
a first angle between a top surface of the fixed plate and a rear surface of the fixed plate is less than 90°,
when the movable plate is in the unfolded position:
the at least one connection shaft is disposed at a front end of the at least one groove,
the movable plate is horizontally arranged side-by-side with the fixed plate, and
the rear surface of the fixed plate abuts a front surface of the movable plate to maintain the movable plate in a horizontal position and to resist a downward force of gravity, and
when the movable plate in the horizontal position rotates upward to a second angle equal to the first angle:
the movable plate slides relative to the at least one connection shaft until the at least one connection shaft moves to a rear end of the at least one groove in the at least one groove, and
the top surface of the movable plate abuts the rear surface of the fixed plate.

2. The top tray of the folding ladder according to claim 1, wherein:
the at least one connection shaft comprises two connection shafts,
the two connection shafts are symmetrically disposed on two sides of the fixed plate,
the at least one groove comprises two grooves, and
the two grooves are symmetrically disposed on two sides of the movable plate.

3. The top tray of the folding ladder according to claim 2, wherein:
at least one shaft sleeve is disposed at a position where the top surface of the fixed plate and the rear side of the fixed plate are connected,
each of the at least one shaft sleeve is coupled to a corresponding one of the two grooves,
each of the two connection shafts is disposed in a corresponding one of the at least one shaft sleeve, and
the two ends of each of the two connection shafts extend outwardly.

4. The top tray of the folding ladder according to claim 2, wherein:
the rear surface of the fixed plate and the front surface of the movable plate are inclined surfaces and are coupled with each other.

5. The top tray of the folding ladder according to claim 1, wherein the rear surface of the fixed plate and the front surface of the movable plate are inclined surfaces and are coupled with each other.

6. The folding ladder, comprising:
a front ladder frame,
a rear ladder frame, and
the top tray of claim 1, wherein:
each of two standing columns on a left side and a right side of the rear ladder frame is pivotally connected to a corresponding one of two standing columns on a left side and a right side of the front ladder frame, and
the fixed plate of the top tray is fixedly connected to a top end of each of the two standing columns on the left side and the right side of the front ladder frame.

7. The folding ladder according to claim 6, wherein:
each of the at least one connection shaft is disposed along the left-right direction of the fixed plate at a position where a top surface of the fixed plate is connected to the rear side of the fixed plate.

8. The folding ladder according to claim 7, wherein:
the at least one connection shaft comprises two connection shafts,
the two connection shafts are symmetrically disposed on two sides of the fixed plate,
the at least one groove comprises two grooves, and
the two grooves are symmetrically disposed on two sides of the movable plate.

9. The folding ladder according to claim 8, wherein:
at least one shaft sleeve is disposed at a position where the top surface of the fixed plate and the rear side of the fixed plate are connected,
each of the at least one shaft sleeve is coupled to a corresponding one of the two grooves,
each of the two connection shafts is disposed in a corresponding one of the at least one shaft sleeve, and
the two ends of each of the two connection shafts extend outwardly.

10. The folding ladder according to claim 6, wherein the rear surface of the fixed plate and the front surface of the movable plate are inclined surfaces and are coupled with each other.

11. A top tray of a folding ladder, comprising:
a fixed plate, and
a movable plate, wherein:
the movable plate is disposed on a rear side of the fixed plate and is rotatably connected to the fixed plate,
the movable plate is configured to be rotated to switch between an unfolded position and a folded position,
each of at least one connection shaft is disposed along a left-right direction of the fixed plate at a position where a top surface of the fixed plate is connected to the rear side of the fixed plate,
a top surface of the movable plate is disposed with at least one groove extending in a front-rear direction of the movable plate,
a left side and a right side of each of the at least one groove are respectively disposed with a slide groove extending in the front-rear direction of the movable plate,
the at least one connection shaft is disposed in the at least one groove and two ends of the at least one connection shaft are slidably and rotatably connected to a respective one of the slide grooves disposed on the left side and the right side of the at least one groove, the at least one connection shaft comprises two connection shafts, the two connection shafts are symmetrically disposed on two sides of the fixed plate, the at least one groove comprises two grooves, the two grooves are symmetrically disposed on two sides of the movable plate, at least one shaft sleeve is disposed at a position where the top surface of the fixed plate and the rear side of the fixed plate are connected, each of the at least one shaft sleeve is coupled to a corresponding one of the two grooves, each of the two connection shafts is disposed in a corresponding one of the at least one shaft sleeve, the two ends of each of the two connection shafts extend outwardly, when the movable plate is in the unfolded position:

the at least one connection shaft is disposed at a front end of the at least one groove, the movable plate is horizontally arranged side-by-side with the fixed plate, and a rear surface of the fixed plate abuts a front surface of the movable plate to maintain the movable plate in a horizontal position and to resist a downward force of gravity, and when the movable plate is subjected to an upward pushing force and is rotated from the horizontal position to be folded into the folded position:

the movable plate is configured to slide relative to the at least one connection shaft until the at least one connection shaft moves to a rear end of the at least one groove, and the movable plate abuts the rear side of the fixed plate.

12. A folding ladder, comprising:

a front ladder frame, a rear ladder frame, and a top tray, wherein:

the top tray comprises a fixed plate and a movable plate, the movable plate is disposed on a rear side of the fixed plate and is rotatably connected to the fixed plate, the movable plate is configured to be rotated to switch between an unfolded position and a folded position, each of two standing columns on a left side and a right side of the rear ladder frame is pivotally connected to a corresponding one of two standing columns on a left side and a right side of the front ladder frame, the fixed plate of the top tray is fixedly connected to a top end of each of the two standing columns on the left side and the right side of the front ladder frame, each of at least one connection shaft is disposed along a left-right direction of the fixed plate at a position where a top surface of the fixed plate is connected to the rear side of the fixed plate, a top surface of the movable plate is disposed with at least one groove extending in a front-rear direction of the movable plate, a left side and a right side of the at least one groove are respectively disposed with a slide groove extending in the front-rear direction of the movable plate, the at least one connection shaft is disposed in the at least one groove and two ends of the at least one connection shaft are slidably and rotatably connected to a respective one of the slide grooves disposed on the left side and the right side of the at least one groove, at least one shaft sleeve is disposed at a position where the top surface of the fixed plate and the rear side of the fixed plate are connected, the at least one connection shaft comprises two connection shafts, the two connection shafts are symmetrically disposed on two sides of the fixed plate, the at least one groove comprises two grooves, the two grooves are symmetrically disposed on two sides of the movable plate, each of the at least one shaft sleeve is coupled to a corresponding one of the two grooves, each of the two connection shafts is disposed in a corresponding one of the at least one shaft sleeve, the two ends of each of the two connection shafts extend outwardly, and when the movable plate is in the unfolded position:

the at least one connection shaft is disposed at a front end of the at least one groove, the movable plate is horizontally arranged side-by-side with the fixed plate, and a rear surface of the fixed plate abuts a front surface of the movable plate to maintain the movable plate in a horizontal position and to resist a downward force of gravity, and when the movable plate is subjected to an upward pushing force and is rotated from the horizontal position to be folded into the folded position:

the movable plate is configured to slide relative to the at least one connection shaft until the at least one connection shaft moves to a rear end of the at least one groove, and the movable plate abuts the rear side of the fixed plate.

* * * * *